United States Patent [19]

Takahashi et al.

[11] Patent Number: 4,575,481

[45] Date of Patent: Mar. 11, 1986

[54] LIGHT-SENSITIVE MATERIAL FOR COLOR DIFFUSION TRANSFER WITH MIXED OXIDIZED DEVELOPER SCAVENGER PARTICLES

[75] Inventors: Osamu Takahashi; Katsumi Makino, both of Kanagawa, Japan

[73] Assignee: Fuji Photo Film Co., Ltd., Kanagawa, Japan

[21] Appl. No.: 707,327

[22] Filed: Mar. 1, 1985

[30] Foreign Application Priority Data

Mar. 1, 1984 [JP] Japan ..... 59-39654

[51] Int. Cl.[4] ..... G03C 1/40; G03C 5/54

[52] U.S. Cl. ..... 430/214; 430/212; 430/215; 430/222

[58] Field of Search ..... 430/214, 215, 222, 212

[56] References Cited

U.S. PATENT DOCUMENTS 4,277,553 7/1981 Onodera et al. ..... 430/214

4,366,236 12/1982 Takahashi ..... 430/214

OTHER PUBLICATIONS

"Oxidized Developer Scavenger . . . ", *Research Disclosure* No. 15234, 12/1976, pp. 19 & 20.

"Photographic Processes and Products", *Research Disclosure* No. 15162, 11/1976, pp. 75–87.

*Primary Examiner*—Richard L. Schilling

*Attorney, Agent, or Firm*—Sughrue, Mion, Zinn, Macpeak and Seas

[57] ABSTRACT

A photographic light-sensitive material for a color diffusion transfer process is described, comprising a support having provided thereon (1) at least two silver halide emulsion layers which are in combination with dye-releasing redox compounds, and (2) an intermediate layer between said silver halide emulsion layers; the intermediate layer comprises a hydrophilic colloid having dispersed therein two or more different kinds of particles, with one or more kinds of said particles containing a scavenger for an oxidized product of a developing agent. The material has an improved processing temperature latitude.

9 Claims, No Drawings

LIGHT-SENSITIVE MATERIAL FOR COLOR DIFFUSION TRANSFER WITH MIXED OXIDIZED DEVELOPER SCAVENGER PARTICLES

FIELD OF THE INVENTION

This invention relates to a photographic light-sensitive material, and particularly to a photographic light-sensitive material for a color diffusion transfer process.

BACKGROUND OF THE INVENTION

In photographic light-sensitive materials which contain compounds capable of releasing diffusible dyes upon occurrence of the redox reaction induced by exposure and development of silver halides (called diffusible dye-releasing redox compounds, hereinafter referred to as DRR compounds), and which are developed with a black-and-white developing agent, such as phenidone, particularly in multilayer color photographic light-sensitive materials for a diffusion transfer process, the oxidized product of the developing agent resulting from development of silver halides should act only on the DRR compound which is in combination with said silver halides. Otherwise, color separation of color images becomes poor. For the purpose of preventing the oxidized product of a developing agent from diffusing into a DRR compound-containing layer which is not in combination with a silver halide emulsion layer, it is conventionally known that a layer containing one or more of reducing substances capable of reacting with an oxidized product of a developing agent, such as redox compounds, e.g., hydroquinone derivatives, is provided in photographic light-sensitive materials, as described, e.g., in *Research Disclosure,* Vol. 15, No. 15162 (November 1976).

On the other hand, since hydroquinone or a derivative thereof (i.e., a scavenger for an oxidized product of a developing agent) contained in an intermediate layer reduces and consumes an oxidized product of a developing agent which is produced as a function of development of an emulsion layer and is necessary for image formation, the proportion of the oxidized product of a developing agent which should react with a DRR compound to form a dye image is thus decreased. The extent of the reduction of the proportion of the oxidized product to be reacted varies in a complicated manner depending on the processing temperature and various other factors. Further, the intermediate layer also has indirect influences on the development of silver halides, and the extent of such influences also varies in a complicated manner depending upon the processing temperature and other factors. As a result, the processing temperature dependence of the image density is greatly influenced by the intermediate layer. Thus, it has been necessary to control the processing temperature dependence due to the use of an intermediate layer containing a scavenger, i.e., to develop a technique for extending a processing temperature latitude.

The inventors have already found that an intermediate layer containing dispersed particles integratedly comprising a hydroquinone mixture having a solidification point of 100° C. or lower (i.e., a scavenger of a developing agent oxidation product) and a water-insoluble and organic solvent-soluble homopolymer or copolymer having a repeating unit containing a $$-\underset{\underset{O}{\|}}{C}-O-$$

bond in its main chain or side chain is effective to improve color separation of color images and also to heighten the maximum density, as disclosed in U.S. Pat. No. 4,366,236. As a result of following-up investigations on controlling the activity of the intermediate layer, i.e., reactivity with the developing agent oxidized product, the inventors further found that:

(1) the activity of the intermediate layer can be controlled by changing the dispersed particle size. In other words, the smaller the particle size, the higher the activity, and vice versa;

(2) the activity of the intermediate layer can be controlled by the kind and amount of the high boiling solvent copresent with the scavenger compound in the dispersed particles; and (3) the activity of the intermediate layer can be controlled by the kind and amount of the water-insoluble polymer copresent with the scavenger in the dispersed particles.

However, when the intermediate layer is composed of one kind of a dispersion, sufficient performance in terms of expansion of the processing temperature latitude could not be obtained even making use of the above-described findings.

Research Disclosure, Vol. 152, No. 15239 (December 1976) describes that processing temperature latitude can be improved by a specific combination of scavengers of didodecylhydroquinone and 4-amino-1-hydroxy-N-[α-2,4-di-t-amylphenoxybutyl]-2-naphthamide. However, use of such a specific combination of scavengers gives rise to a problem in that the freedom in controlling the activity of the intermediate layer becomes quite narrow, because the activity of the intermediate layer is determined by the chemical structure of the scavengers.

SUMMARY OF THE INVENTION

Accordingly, an object of this invention is to provide a photographic light-sensitive material for a color diffusion transfer process including a novel intermediate layer that can broaden the processing temperature latitude.

As a result of extensive studies, it has now been found that the above-described object can effectively be achieved by a photographic light-sensitive material for a color diffusion transfer process comprising a support having provided thereon (1) at least two silver halide photographic emulsion layers which are in combination with dye-releasing redox compounds capable of releasing diffusible dyes as a result of redox reaction with an oxidized product of a silver halide developing agent which is formed by processing development with an alkaline processing solution in the presence of a silver halide developing agent (the released diffusive dyes diffuse into an image receiving layer to form a transferred image therein), and (2) an intermediate layer between these silver halide emulsion layers, which comprises a hydrophilic colloid having dispersed therein particles of a reducing substance capable of reacting with the oxidized product of the developing agent (i.e., a scavenger for the developing agent oxidized product), wherein said dispersed particles comprise: (a) a mixture consisting of two or more kinds of dispersed particles, each comprising said reducing component (i.e., the above-described scavenger for a developing agent oxidized product) as a first component and a second component which is miscible with the first component to constitute dispersed particles, wherein said two kinds of dispersed particles differ from each other in that the second component is different among the two or more kinds of dispersed particles, or the proportion of the second component to the first component is different among the two or more kinds of dispersed particles; or (b) a mixture of dispersed particles substantially solely comprising said reducing component as a first component and at least one kind of dispersed particles comprising the same reducing component as said first component and a second component which is miscible with said first component to constitute dispersed particles.

The term "the same reducing component as the first component" used in (b) above includes isomeric mixtures of the first component.

DETAILED DESCRIPTION OF THE INVENTION

The mechanism of improvement in the processing temperature latitude brought about by the light-sensitive material of the present invention is not completely clear, but, as mentioned above, it is certain that the presence of the second component coexisting with the scavenger for a developing agent oxidized product within the same dispersed particle causes a change in the activity of the scavenger. The cause for the change is believed to be due to some mutual interaction between the scavenger and the component coexisting with the scavenger. It is also believed that the interaction varies depending on temperature and that the mode of the change varies depending on the type of the coexisting substance. Therefore, the temperature dependence of the scavenger's activity can be controlled by appropriately mixing at least two dispersions having different compositions to obtain a mixed dispersion for an intermediate layer having an activity adequate to the desired light-sensitive material, whereby light-sensitive materials having an improved processing temperature latitude can be designed.

Thus, in the photographic light-sensitive materials according to the present invention, the color images have good color separation, the intermediate layer exhibits good film quality, the color image has a high maximum density, and the processing temperature latitude can be improved.

The concept of the present invention is greatly different from the above-referred disclosure of *Research Disclosure,* No. 15239 in a point that a single kind of scavenger can be used, and it is the second component having miscibility with the scavenger which brings about a change of activity. Therefore, the present invention is superior in terms of freedom to control the activity of the scavenger continuously and over a broad range.

The second component which can be used in the present invention is miscible with the first component, i.e., a scavenger for an oxidized product of a developing agent, to form dispersed particles, and includes substantially water-insoluble high boiling solvents having a boiling point of about 200° C. or more under atmospheric pressure, and substantially water-insoluble synthetic polymers.

The high boiling solvents include solvents used for introducing photographic couplers into silver halide emulsion layers, such as those described, e.g., in U.S. Pat. No. 2,322,027. Specific examples of these high boiling solvents are alkyl phthalates, e.g., dibutyl phthalate, dioctyl phthalate, etc., phosphoric esters, e.g., diphenyl phosphate, tricyclohexyl phosphate, triphenyl phosphate, tricresyl phosphate, dioctylbutyl phosphate, etc., citric esters, e.g., tributyl acetylcitrate, etc., benzoic esters, e.g., octyl benzoate, etc., alkylamides, e.g., diethyl laurylamide, etc., fatty acid esters, e.g., dibutoxyethyl succinate, diethyl azelate, etc., trimesic esters, e.g., tributyl trimesate, etc., and the like.

The substantially water-insoluble synthetic polymers which can be used as the second component include a water-insoluble and organic solvent-soluble homo- or copolymer having a repeating unit having a

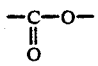

bond in its main chain or side chain, as described in U.S. Pat. No. 4,366,236. Specific examples of such polymer are described in U.S. Pat. No. 4,366,236, and preferred examples thereof are set forth below:

(1) Polyvinyl acetate
(2) Polyvinyl propionate
(3) Vinyl acetate-vinyl alcohol copolymer:(90/10 by weight)
(4) Polymethyl methacrylate
(5) Polyethyl acrylate
(6) Polyethyl methacrylate
(7) Polybutyl acrylate
(8) Polybutyl methacrylate
(9) Polyisobutyl methacrylate
(10) Polyisopropyl methacrylate
(11) Polyoctyl acrylate
(12) Butyl acrylate-acrylamide copolymer (95/5 by weight)
(13) Stearyl methacrylate-acrylic acid copolymer (90/10 by weight)
(14) 1,4-Butanediol-adipic acid polyester
(15) Ethylene glycol-sebacic acid polyester
(16) Polycaprolactone
(17) Polypropiolactone
(18) Polydimethylpropiolactone Specific examples of the scavenger for a developing agent oxidized product which can be useful in the present invention include those compounds described in above-noted Research Disclosure, No. 15162 and U.S. Pat. No. 4,366,236, such as hydroquinones, aminophenols, sulfonamidophenols, sulfonamidonaphthols, etc. Among hydroquinones, those having a solidification point of 100° C. or lower are preferred in the case where a polymer is used as the second component. Details regarding such hydroquinones are described in U.S. Pat. No. 4,366,236, but the particularly preferred among them are isomeric mixtures exemplified by a mixture of hydroquinone compounds having two tertiary alkyl groups having 15 carbon atoms at the 2- and 5- or 2- and 6-positions of the benzene ring thereof and an isomeric mixture of a secondary dodecylhydroquinone.

On the other hand, in cases where high boiling solvents are used as the second component, the kind of the scavengers to be used is not particularly restricted, provided that they are soluble in the high boiling solvents used.

At least two kinds of particles that are different from each other in terms that the proportion of the second component to the scavenger (i.e., the first component) is different or the kind of the second component is different can be dispersed in an intermediate layer in accordance with the method as follows.

The scavenger and the second component are dissolved in a low boiling solvent, and the solution is poured into a hydrophilic colloid, followed by dispersing using an emulsifying and dispersing machine, such as a homogenizer, to prepare a first emulsified dispersion. Then, a second emulsified dispersion is prepared in the same manner as above, except that a second component different from that used in the first emulsified dispersion is used, or the proportion of the second component to the scavenger is varied. In the latter case, the second component to be used may include an isomer of the scavenger used for the preparation of the first emulsified dispersion. The resulting two emulsions are then mixed together to obtain an emulsion having dispersed therein two different kinds of particles. This emulsion can be used "as is" as a coating composition for an intermediate layer, or water may appropriately be added thereto before use.

Dispersing of at least two different kinds of particles in an intermediate layer can also be effected by the above-described method, except that a second component used in one kind of particles is not used in another kind of particles.

The amount of the scavenger to be used in the intermediate layer is not particularly critical, but is preferably in the range of from about 0.4 to 10 mmol/m$^2$. The proportion of the second component to the scavenger is not also particularly restricted, but preferably ranges from about 0.1 to 10 by weight, and more preferably from 0.2 to 4 by weight. The above-described two different emulsions can be mixed in an optional proportion.

The hydrophilic colloid used for dispersing the particles is desirably gelatin, but any other hydrophilic colloids which can be used in the photographic field may also be employed.

The low boiling solvents that can be used for dissolving the scavenger and the second component preferably include those having a boiling point of 100° C. or lower. Among them, ethyl acetate, methyl ethyl ketone, etc., are more preferred because of the ease of removal by drying after coating.

Light-sensitive silver halide emulsions which can be used in the present invention are dispersions of silver chloride, silver bromide, silver chlorobromide, silver iodobromide, silver chloroiodobromide or mixtures thereof in hydrophilic colloids. The halogen composition is selected in accordance with the end use of the light-sensitive materials and processing conditions. In particular, silver bromide, silver iodobromide or silver chloroiodobromide having an iodide content of not more than 10 mol % and a chloride content of not more than 30 mol % are preferred.

The present invention can be applied to either negative emulsions that form a surface latent image or direct reversal emulsions. The latter emulsions include internal latent image type emulsions and previously fogged direct reversal emulsions.

In the present invention, internal latent image type direct reversal silver halide emulsions are advantageously used. Emulsions of this type include conversion type emulsions as described, e.g., in U.S. Pat. Nos. 2,592,250, 3,206,313, 3,447,927, 3,761,276 and 3,935,014, etc.; core-shell type emulsions; emulsions having incorporated therein different metals; and the like.

Nucleating agents used in the above-described type of emulsions typically include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Pat. Publication No. 38164/74, U.S. Pat. Nos. 4,115,122, 3,734,738, 3,719,494 and 3,615,615; sensitizing dyes having nucleating substituents in their molecule described in U.S. Pat. No. 3,718,470; thiourea-bonded acylhydrazine compounds described in U.S. Pat. Nos. 4,030,925, 4,031,127, 4,245,037, 4,255,511, 4,266,013 and 4,276,364, etc.; and urea type acylhydrazine compounds described in U.S. Pat. No. 4,374,923.

The DRR compounds which can be used in the present invention are immobile under an alkaline processing condition, and are generally represented by the formula (I):

(Ballast) (Link) (Dye) (I)

wherein (Ballast) represents a ballast group for immobilizing the DRR compound under an alkaline processing condition; (Dye) represents a dye group capable of moving in a photographic layer under an alkaline processing condition or a precursor thereof; and (Link) represents a redox cleavable group which is split off (negative type) or inhibited from splitting off (positive type) upon oxidation accompanied by development.

Examples of the negative type "Link" group are described, e.g., in U.S. Pat. Nos. 4,053,312, 4,135,929 and 4,336,322, Japanese Pat. Application (OPI) Nos. 33826/73, 104343/76, 46730/78, 130122/79, 113624/76, 12642/81, 161131/81, 4043/82, 650/82, 20735/82, 54021/79, 71072/81, etc. (the term "OPI" as used herein refers to a "published unexamined Japanese patent application"). One specific but not limitative example thereof is an N-substituted sulfamoyl group, with a preferred substituent being an aryl group, as in the specific examples of (Ballast) (Link) shown below.

Specific examples of (Ballast) (Link) which releases a diffusible dye are set forth below.

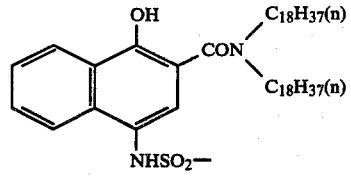

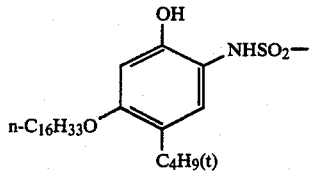

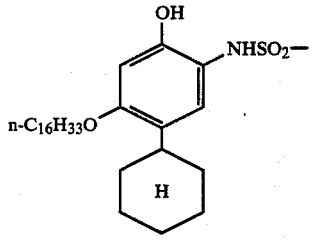

-continued

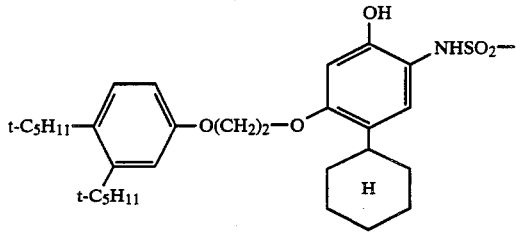

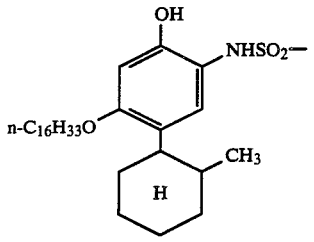

Examples of the positive "Link" are described, e.g., in U.S. Pat. Nos. 4,199,354, 4,199,355, 4,139,379, 4,139,389, 3,719,489 and 4,098,783, Japenese Pat. Application (OPI) Nos. 111628/74, 63618/76, 69033/78, 130927/79, 164342/81 and 4819/77, Japenese Pat. Application No. 60289/83, etc. Preferred specific examples of such groups are set forth below.

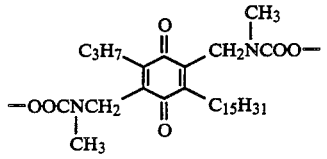

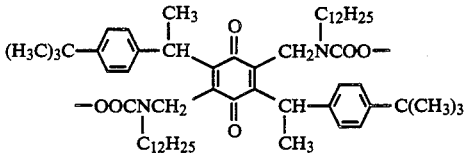

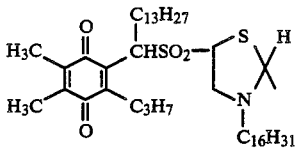

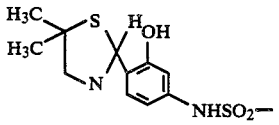

Of the positive dye-donating compounds, those capable of releasing dyes by reduction as typically exemplified by a quinone skeleton are known to be used in combination with a nondiffusion electron-donator (also known as an ED compound) or a precursor thereof. Examples of the ED compounds are described, e.g., in U.S. Pat. Nos. 4,263,393 and 4,278,750 and Japanese Pat. Application (OPI) No. 138736/81, etc.

The positive DRR compounds may be those of the type containing an electron-donating moiety in their molecule and capable of releasing a dye upon intramolecular oxidation-reduction reaction.

The dyes released from the DRR compounds may be either complete dyes or dye precursors that can be converted to dyes during photographic processing steps or following-up processing steps. The final image dyes may or may not be chelated. Typical examples of the dyes are chelated or non-chelated azo dyes, azomethine dyes, anthraquinone dyes or phthalocyanine dyes. Of these, cyan, magenta, and yellow azo dyes are particularly useful.

Specific examples of the yellow dyes are described in U.S. Pat. Nos. 3,597,200, 3,309,199, 4,013,633, 4,139,383, 4,156,609, 4,195,992, 4,148,641, 4,148,643, 4,245,028 and 4,336,322, Japanese Pat. Application (OPI) Nos. 114930/76 and 71072/81, *Research Disclosure,* 17630 (1978), *ibid.,* 16475 (1977), etc.

Specific examples of the magenta dyes are described in U.S. Pat. Nos. 3,453,107, 3,544,545, 3,932,380, 3,931,144, 3,932,308, 3,954,476, 4,142,891, 4,207,104, 4,233,237, 4,250,246, 4,255,509 and 4,287,292, Japanese Pat. Application (OPI) Nos. 106727/77, 23628/78, 36804/80, 73057/81, 71060/81, 134/80, etc.

Specific examples of the cyan dyes are described in U.S. Pat. Nos. 3,482,972, 3,929,760, 4,013,635, 4,142,891, 4,147,544, 4,148,642, 4,171,220, 4,195,994, 4,242,435 and 4,268,625, British Pat. No. 1,551,138, Japanese Pat. Application (OPI) Nos. 99431/79, 8827/77, 47823/78, 143323;78, 99431/79 and 71061/81, EPC Pat. Nos. 53,037 and 53,040, *Research Disclosure,* 17630 (1978), *ibid.,* 16475 (1977), etc.

As dye precursors, DRR compounds having a dye moiety having its light absorption temporarily shifted when present in a light-sensitive element can be used. Specific examples of such dye precursors are described in Japanese Pat. Application (OPI) Nos. 53330/80 and 53329/80, U.S. Pat. Nos. 3,336,287, 3,579,334 and 3,982,946, British Pat. No. 1,467,317, etc.

The DRR compound is coated in an amount of from $1\times10^{-4}$ to $1\times10^{-2}$ mol/m$^2$, and preferably from $2\times10^{-4}$ to $2\times10^{-3}$ mol/m$^2$ Reproduction of natural color by a subtractive color process involves use of a light-sensitive material comprising at least a combination of an emulsion showing selective spectral sensitivity in a certain wavelength region and a DRR compound showing selective spectral sensitivity in the same wavelength region.

Light-sensitive materials comprising a combination of a blue-sensitive silver halide emulsion and a yellow DRR compound, a combination of a green-sensitive emulsion and a magenta DRR compound, and a combination of a red-sensitive emulsion and a cyan DRR compound are particularly useful. Each of these combination units may be provided in layers in the light-sensitive material so as to face each other or may be formed in particles so that the DRR compound and the silver halide grains are present in the same particles, mixed together, and coated in one layer.

An image-receiving element containing at least a mordanting layer, a neutralizing layer, a neutralization speed controlling layer (i.e., a timing layer), a reflecting layer, a light-screening layer, a cover sheet, etc., which can be applied to the light-sensitive materials according to the present invention, is described, e.g., in Japanese Pat. Application (OPI) No. 64533/77.

Polymer mordants which can be used in the mordanting layer include polymers containing secondary and tertiary amino groups, polymers having a nitrogen-containing heterocyclic moiety, and polymers containing quaternary cationic groups thereof. These polymers have a molecular weight of 5,000 or more, and preferably 10,000 or more.

Known silver halide developing agents can be employed for processing the light-sensitive materials of the present invention, provided that they produce an oxidized product capable of cross-oxidizing the DRR compound. Specific examples of the usable developing agents include 3-pyrazolidinones, e.g., 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone, 1,5-diphenyl-3-pyrazolidinone, etc.; aminophenols, e.g., p-aminophenol, p-methylaminophenol, p-dimethylaminophenol, p-diethylaminophenol, p-dibutylaminophenol, p-piperidinoaminophenol, 4-dimethylamino-2,6-dimethoxyphenol, etc.; phenylenediamines, e.g., N-methyl-p-phenylenediamine, N,N-dimethyl-p-phenylenediamine, N,N-diethyl-p-phenylenediamine, N,N,N',N'-tetramethyl-p-phenylenediamine, 4-diethylamino-2,6-dimethoxyaniline, etc.; reductones, e.g., piperidinohexose reductone, pyrrolidinohexose reductone, etc.; and the like. These developing agents can be used alone or in combinations thereof.

In a preferred embodiment of the light-sensitive materials according to the present invention, the support has provided thereon an image-receiving layer, a light-reflecting layer for substantially shielding light (composed of, e.g., a titanium dioxide layer and a carbon black layer), the above-described intermediate layer interposed between at least two light-sensitive layers (combined with the DRR compounds), and a transparent cover sheet. A container destroyable upon application of pressure, which contains an alkaline processing solution containing an opacity-imparting agent, e.g., carbon black, is provided adjacent to the outermost layer (protecting layer) and to the transparent cover sheet. Such a film unit is exposed to light through a transparent cover sheet, and when it is taken out of a camera, the container is destroyed by a press element so that the alkaline processing solution may be spread between light-sensitive layers and a cover sheet over the entire area, whereby development proceeds in the light under the condition that the light-sensitive layers are protected from light in a sandwich form.

It is preferable that the light-sensitive material of the present invention contains a neutralization element. It is particularly preferable to provide a neutralizing layer on a cover sheet, and, if desired, to further provide a timing layer on a cover sheet on the side where the processing solution is spread.

In the above-described embodiment, after completion of the transferred image formation, the element containing an image-receiving layer (color print) may be peeled away from the element containing the light-sensitive layers, if desired.

In another embodiment of the present invention, a film unit comprises a transparent support having provided thereon a neutralizing layer, a timing layer and a mordanting layer and another support having provided thereon the above-described light-sensitive layers and intermediate layer, and these two elements are assembled so that the processing solution may be spread therebetween. Such a film unit may be either a peel-off type or a non-peel-off type.

The present invention will now be illustrated in greater detail with reference to examples, but the examples are not to be deemed to limit the present invention. Unless otherwise indicated, all parts, percents, ratios and the like are by weight.

EXAMPLE 1

Preparation of Light-Sensitive Sheet

Onto a transparent polyethylene terephthalate film support, the following layers were coated in the order listed:

(1) A mordanting layer containing 3.0 g/m$^2$ of copoly[styrene-N-vinylbenzyl-N,N,N-trihexylammonium chloride] and 3.0 g/m$^2$ of gelatin.

(2) A light-reflecting layer containing 20 g/m$^2$ of titanium dioxide and 2.0 g/m$^2$ of gelatin.

(3) A light-screening layer containing 3.0 g/m$^2$ of carbon black and 2.0 g/m$^2$ of gelatin.

(4) A layer containing 0.44 g/m$^2$ of a cyan dye-releasing redox compound having the following formula, 0.09 g/m$^2$ of tricyclohexyl phosphate and 0.8 g/m$^2$ of gelatin.

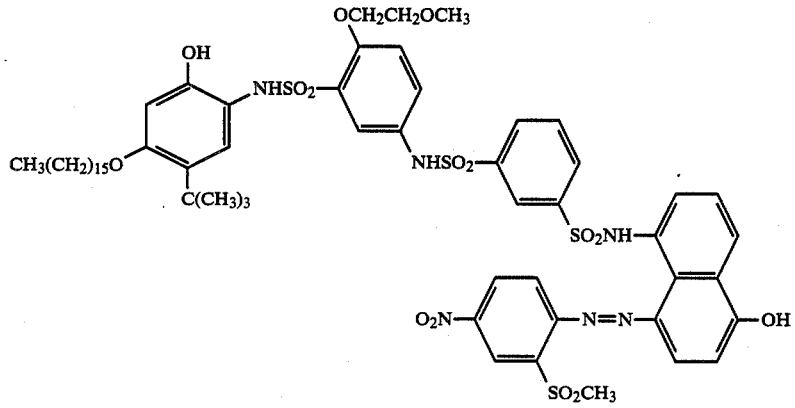

(5) A layer containing a red-sensitive internal latent image type direct reversal silver bromide emulsion (silver coverage: 1.03 g/m$^2$: gelatin coverage: 1.2 g/m$^2$), 0.07 mg/m$^2$ of a nucleating agent having the following structure and 0.13 g/m$^2$ of sodium 2-sulfo-5-n-pentadecylhydroquinone.

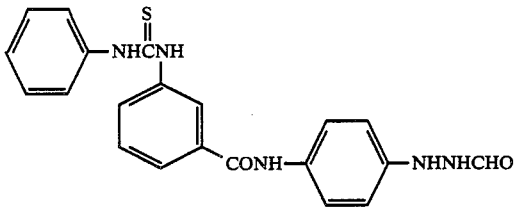

(6) An intermediate layer containing a scavenger for an oxidized product of a developing agent, containing the emulsion indicated 1, or a mixture thereof at a mixing ratio in Table 2, in such an amount that the coverage of the scavenger, 2,6-di-t-pentadecylhydroquinone, was 1.2 g/m$^2$.

(7) A layer containing 0.21 g/m$^2$ of a magenta dye-releasing redox compound having the following structure I, 0.11 g/m$^2$ of dye-releasing redox compound having the structure II, 0.08 g/m$^2$ of tricyclohexyl phosphate and 0.9 g/m$^2$ of gelatin.

Structure I:

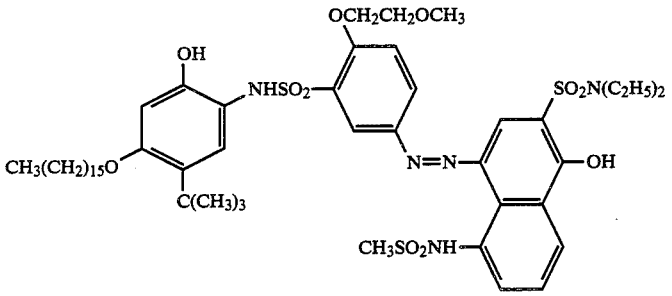

Structure II:

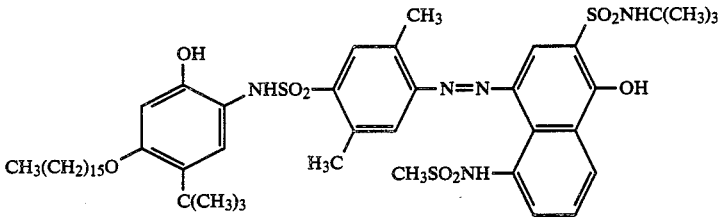

(8) A layer containing a green-sensitive internal latent image type direct reversal silver bromide emulsion (silver coverage: 0.82 g/m$^2$: gelatin coverage: 0.9 g/m$^2$), 0.04 mg/m$^2$ of the same nucleating agent as used layer (5) and 0.08 g/m$^2$ of sodium 2-sulfo-5-n-pentadecylhydroquinone.

(9) An intermediate layer containing a color mixing preventing agent of 0.8 g/m$^2$ of gelatin, 1.0 g/m$^2$ of 2,5-di-t-pentadecylhydroquione and 1.0 g/m$^2$ of polymethyl methacrylate.

(10) A layer containing 0.53 of a yellow dye-releasing redox compound having the following structure, 0.13 g/m$^2$ of phosphate and 0.7 g/m$^2$ of gelatin.

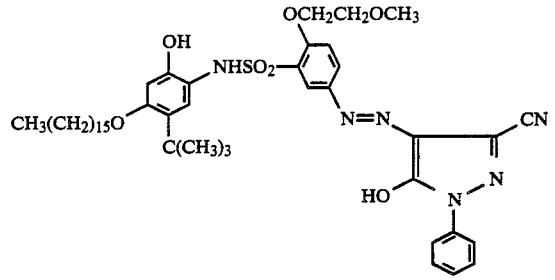

(11) A layer containing a blue-sensitive internal latent image type direct reversal silver bromide emulsion (silver coverage: 1.09 g/m$^2$; gelatin coverage: 1.1 g/m$^2$), 0.04 mg/m$^2$ of the same nucleating agent as used layer (5) and 0.07 g/m$^2$ of sodium 2-sulfo-5-n-pentadecylhydroquinone.

(12) A layer containing 1.0 g/m$^2$ of gelatin.

Preparation of Cover Sheet

Onto a transparent polyester support, the following layers (1') to (3') coated in the order listed:

(1') A layer containing 22 g/m$^2$ an acrylic acidbutyl acrylate copolymer (80/20 by weight) and 0.44 g/m$^2$ of 1,4-bis(2,2-epoxypropoxy)butane.

(2') A layer containing 3.8 g/m$^2$ cellulose having such an acetyl value that hydrolysis of a 100 g sample produces 39 g of an acetyl group, 0.2 g/m$^2$ of a styrene-maleic anhydride copolymer (60/40 by weight; molecular weight: ca. 50,000) and 0.115 g/m$^2$ of 5-($\beta$-cyanoethylthio)-1-phenyltetrazole.

(3') A layer containing 2.5 of a vinylidene chloride-methyl acrylate-acrylic acid copolymer latex (85/12/3 by weight) 0.05 g/m$^2$ of a polymethyl methacrylate (particle size: 1 to 3 $\mu$m).

For the preparation of scavenger-containing intermediate layer (6), Emulsions A to E were prepared from components shown in Table 1 (the amounts were per kg of the emulsion) and mixed in accordance with Table 2 (the mixing ratios are by weight).

TABLE 1

| Component | Emulsion A | B | C | D | E |
|---|---|---|---|---|---|
| First Component: | | | | | |
| 2,5-Di-t-pentadecyl-hydroquinone (g) | 100 | 100 | 100 | 100 | 100 |
| Second Component: | | | | | |
| Tricyclohexyl phosphate (g) | — | 50 | — | — | — |
| Polymethyl methacrylate (g) | — | — | 70 | 140 | — |
| Polyvinyl acetate (g) | — | — | — | — | 100 |
| Hydrophilic Colloid: | | | | | |
| Gelatin (g) | 120 | 120 | 120 | 120 | 120 |

TABLE 2

| Sample No. | Emulsion for Layer (6) |
|---|---|
| 1 | A |
| 2 | B |
| 3 | C |
| 4 | D |
| 5 | E |
| 6 | 1/2 Mixture of A and D |
| 7 | 1/1 Mixture of B and D |
| 8 | 1/1.5 Mixture of C and E |

Using the emulsions shown in Table 2, Light-Sensitive Sheets 1 to 8 were thus produced.

Each of the resulting light-sensitive materials was exposed to light emitted from a tungsten lamp (2,854° K.) and converted to 4,800° K. using a Davis Gibson filter from the side of the light-sensitive layer through a continuous wedge. At this time, the maximum exposure was 10 CMS. The thus exposed sample was processed using a container containing a processing solution having the following formulation and a cover sheet.

| Formulation of Processing Solution: | |
|---|---|
| 1-p-Tolyl-4-hydroxymethyl-4-methyl-3-pyrazolidinone | 12 g |
| Methylhydroquinone | 0.3 g |
| 5-Methylbenzotriazole | 3.5 g |
| Anhydrous Sodium Sulfite | 0.2 g |
| Sodium Carboxymethyl Cellulose | 43 g |
| Potassium Hydroxide | 56 g |
| Benzyl Alcohol | 1.5 ml |
| Carbon Black | 150 g |
| Water to make | 1,000 g |

The container was then ruptured by a press element under the conditions of 10° C., 25° C., or 35° C., in temperature, to thereby develop the processing solution. One day later, the transferred dye density was measured by the use of a color densitometer, and the results obtained are shown in Table 3. The yellow densities are not shown in Table 3 as there is no substantial difference.

TABLE 3

| Sample No. | Magenta $D_{max}^{35°}-D_{max}^{25°}$ | Magenta $D_{max}^{25°}-D_{max}^{10°}$ | Cyan $D_{max}^{35°}-D_{max}^{25°}$ | Cyan $D_{max}^{25°}-D_{max}^{10°}$ | Remark |
|---|---|---|---|---|---|
| 1 | +0.15 | +0.52 | +0.18 | +0.40 | Comparison |
| 2 | +0.12 | +0.40 | +0.07 | +0.24 | " |
| 3 | +0.24 | +0.25 | −0.11 | +0.18 | " |
| 4 | −0.10 | +0.17 | −0.13 | +0.12 | " |
| 5 | −0.15 | +0.21 | −0.18 | +0.20 | " |
| 6 | +0.08 | +0.20 | +0.10 | +0.14 | Invention |
| 7 | +0.02 | +0.16 | +0.01 | +0.12 | " |
| 8 | +0.01 | −0.22 | −0.10 | +0.20 | " |

It can be seen from Table 3 that the absolute values of ($D_{max}^{35°}-D_{max}^{25°}$) and ($_{max}^{25°}-D_{max}^{10°}$) of the magenta and/or cyan dyes are markedly lower in Sample Nos. 6 to 8 in which dispersions comprising two different kinds of dispersions containing the same scavenger for a developing agent oxidized product but having different compositions than in Sample Nos. 1 to 5 in which dispersions of the same composition were used. These results prove that use of such a mixture of different kinds of dispersions significantly reduces dependence of transferred image density on the temperature at which a light-sensitive sheet is processed.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material for a color diffusion transfer process comprising a support having provided thereon (1) at least two silver halide emulsion layers which are in combination with dye-releasing redox compounds capable of releasing diffusible dyes upon redox reaction with an oxidized product of a silver halide developing agent which is formed by processing development with an alkaline processing solution in the presence of a silver halide developing agent, and (2) an intermediate layer between said silver halide emulsion layers which comprises a hydrophilic colloid having dispersed therein particles containing a reducing component capable of reacting with the oxidized product of the developing agent, wherein said particles comprise:

(a) a mixture consisting of two or more kinds of dispersed particles, each comprising said reducing component as a first component and a second component which is miscible with the first component to constitute dispersed particles, wherein said two or more kinds of dispersed particles differ from each other in that the second component is different among the two or more kinds of dispersed particles, or the proportion of the second component to the first component is different among the two or more kinds of dispersed particles; or (b) a mixture consisting of dispersed particles substantially solely comprising said reducing component as a first component and one or more kinds of dispersed particles comprising the same reducing component as said first component and a second component which is miscible with said first component to constitute dispersed particles.

2. A photographic light-sensitive material as in claim 1, wherein said second component is a high boiling solvent which is substantially water-insoluble and has a boiling point of about 200° C. or more.

3. A photographic light-sensitive material as in claim 1, wherein said second component is a substantially water-insoluble synthetic polymer.

4. A photographic light-sensitive material as in claim 3, wherein the polymer is a water-insoluble and organic solvent-soluble homo- or copolymer containing a repeating unit having a

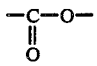

bond in its main chain or side chain.

5. A photographic light-sensitive material as in claim 3, wherein the first component is a hydroquinone having a solidification point of 100° C. or less.

6. A photographic light-sensitive material as in claim 5, wherein said hydroquinone is a mixture of hydroquinone compounds substituted with two tertiary alkyl groups having 15 carbon atoms at the 2- and 5-positions or 2- and 6-positions of the benzene rings thereof or an isomeric mixture of sec-dodecylhydroquinone.

7. A photographic light-sensitive material as in claim 1, wherein the reducing component is present in the intermediate layer in an amount of from about 0.4 to 10 mmol/$m^2$.

8. A photographic light-sensitive material as in claim 1, wherein the second component is present in the intermediate layer in a weight proportion of from about 0.1 to 10 with respect to the first component.

9. A photographic light-sensitive material as in claim 8, wherein the second component is present in the intermediate layer in a weight proportion of from 0.2 to 4 with respect to the first component.

* * * * *